US006196284B1

(12) United States Patent
Lequin

(10) Patent No.: US 6,196,284 B1
(45) Date of Patent: Mar. 6, 2001

(54) WOOD PULVERIZER WITH IMPROVED GRATES AND GRATE COMPONENTS

(76) Inventor: Dana Lequin, 273 Little Egypt Rd., Summerville, GA (US) 30747

( * ) Notice: Subject to any disclaimer, the term of this patent is extended or adjusted under 35 U.S.C. 154(b) by 0 days.

(21) Appl. No.: 09/255,422

(22) Filed: Feb. 22, 1999

Related U.S. Application Data

(60) Continuation-in-part of application No. 08/811,865, filed on Mar. 5, 1997, now Pat. No. 5,873,397, which is a division of application No. 08/561,825, filed on Nov. 27, 1995, now Pat. No. 5,649,578, which is a continuation-in-part of application No. 08/206,713, filed on Mar. 7, 1994, now Pat. No. 5,469,901.

(51) Int. Cl.[7] ..... B27C 1/00

(52) U.S. Cl. ..... 144/163; 144/172; 144/174; 144/176; 144/373; 144/241; 241/84; 241/69; 241/92; 241/278.1; 241/291; 241/296

(58) Field of Search ..... 144/162.1, 163, 144/172, 173, 174, 176, 373, 241; 241/55, 188, 68, 69, 70, 74, 78, 92, 277, 98.1, 278.1, 225, 286, 83, 84, 189.1, 273.1, 273.2, 273.4, 291, 296

(56) References Cited

U.S. PATENT DOCUMENTS

| | | | |
|---|---|---|---|
| 1,215,424 | 2/1917 | Spensley . | |
| 1,221,952 | 4/1917 | Adams . | |
| 1,403,698 | 1/1922 | Letz . | |
| 1,515,798 | 11/1924 | Spensley . | |
| 1,624,037 | 4/1927 | Butler . | |
| 1,666,640 | 4/1928 | Cunniff . | |
| 1,704,757 | 3/1929 | Mead, Jr. . | |
| 1,811,438 | 6/1931 | Riley et al. . | |
| 1,947,953 | 2/1934 | Otto | 83/11 |
| 2,033,757 | 3/1936 | Crites . | |
| 2,075,506 | 3/1937 | Crites et al. . | |
| 2,084,227 | 6/1937 | Swanson | 83/11 |
| 2,225,797 | 12/1940 | Plauson | 83/93 |
| 2,226,429 | 12/1940 | Hall | 83/8 |
| 2,306,857 | 12/1942 | Behnsen | 83/6 |
| 2,321,599 | 6/1943 | Hofmann | 259/7 |
| 2,623,700 | 12/1952 | Scherer . | |
| 2,709,552 | 5/1955 | Lecher . | |
| 2,888,211 | 5/1959 | Myers et al. . | |
| 2,888,212 | 5/1959 | Albert et al. | 241/46 |
| 2,888,213 | 5/1959 | Hubner et al. | 241/46 |
| 3,028,105 | 4/1962 | Perrine . | |
| 3,047,243 | 7/1962 | Meger et al. . | |
| 3,260,469 | 7/1966 | Perdreau | 241/257 |
| 3,411,724 | 11/1968 | Noe . | |
| 3,894,695 | 7/1975 | Benedikter | 241/55 |

*Primary Examiner*—W. Donald Bray
(74) *Attorney, Agent, or Firm*—Womble Carlyle Sandridge & Rice

(57) ABSTRACT

An improved wood pulverizer is provided with a rotating disc studded with a plurality of curved tapered hammers. One or more anvils is secured to the pulverizer with the anvil having teeth and slots located adjacent the surface of the disc. The hammers of the rotating disc pass through the slots of the anvils as the disc rotates to tear and shard wood into bits and pieces for subsequent use or processing. The anvils of the present invention are formed with two or more useable surfaces so that the anvils can be removed, rotated, and replaced to present fresh cutting surfaces to the disc. Further, the anvils are formed by a series of bolted together anvil segments to allow replacement of only single segments in the event of damage. Improved chip sizing grates are also provided with the grates having replaceable reversible gullet liners and grate rings formed by ring segments that together define a grate liner. Rotor rings are provided in some embodiments.

32 Claims, 9 Drawing Sheets

WOOD PULVERIZER WITH IMPROVED GRATES AND GRATE COMPONENTS

REFERENCE TO RELATED APPLICATIONS

This application is a continuation-in-part of my U.S. application Ser. No. 08/811,865 filed on Mar. 5, 1997, now U.S. Pat. No. 5,873,397, which is a divisional of U.S. patent application Ser. No. 08/561,825 filed Nov. 27, 1995, now U.S. Pat. No. 5,649,578, which, in turn, is a continuation-in-part of U.S. patent application Ser. No. 08/206,713, filed Mar. 7, 1994, now U.S. Pat. No. 5,469,901.

TECHNICAL FIELD

This invention relates generally to wood and log processing machinery and more particularly to wood hogs and chippers for shredding and cutting wood into chips and shards for subsequent use or disposal.

BACKGROUND OF THE INVENTION

Cylindrical drum-type wood chippers for reducing logs, ranches, roots, and the like to wood chips are well known. In general, drum-type chippers comprise a rotating cylindrical drum having an exterior surface studded either with hammers or sharpened chipper knife blades depending upon the desired consistency of the finished chips. Sharpened chipper blades, for example, tend to produce neatly cut wood chips while hammers tend to pulverize, shred, and tear the wood into randomly shaped shards. In use, logs and branches are fed to the rotating drum where the moving hammers or knives reduce them into small pieces that can be transported easily or be used for pulp, mulch, or the like.

Examples of drum type wood chippers are found in U.S. Pat. Nos. 4,802,631 of Arasmith, 4,785,860 of Arasmith, 1,418,735 of Plaisted, and 3,801,027 of Kubitz. In most of these examples, logs to be processed are fed to the surface of the rotating drum by a feeder mechanism such as a conveyor or feed roll. The blades of the drum are configured to impact, cut, and chip the log into pieces of roughly the same size, whereupon the pieces are discharged from the machine through a discharge chute.

Disc chippers have been developed as an alternative to drum type chippers. These disc chippers employ a rotating knife or hammer bearing disc rather than a cylindrical drum to reduce wood to chips. A good example of a disc chipper is presented in U.S. Pat. No. 4,827,989 of Strong. Other examples are illustrated in U.S. Pat. Nos. 1,195,774 of Brown, 3,732,907 of Nystrom, and 4,736,781 of Morey et al. In addition, a unique and improved disc type chipper is disclosed and claimed in my own U.S. Pat. No. 5,469,901, of which the present application is a continuation-in-part. The disclosure of my said patent is hereby incorporated by reference in order to provide a good background for the particular improvements and disclosures of the present application.

In general, disc type chippers comprise a housing that carries a rapidly spinning metal disc having knives or hammers mounted on the surface of the disc. Wood to be processed is fed to the disc surface, usually at an angle, where the knives or hammers reduce the wood to chips and shards. The chips and shards, when cut, can either pass through gullets in the disc, can be discharged through a sizing grate, or can be transferred to the back side of the disc for additional processing.

Many disc-type chippers and drum-type chippers have moving surfaces that are studded with hammers or knives that protrude outwardly from the surface. In the case of disc-type chippers having hammers, these hammers usually comprise a rectangular block of metal that is secured with screws or weld joints to the surface of the disc so that the hammers protrude therefrom. Usually, the hammers are arranged along preselected radii of the disc so that they can pass through slots formed in metal anvils that are secured adjacent to the surface of the disc. The interactions of the hammers and anvils generates a scissor action that shreds and cuts the wood into small pieces and shards that can be subsequently processed or discharged from the machine. Typically, as disclosed in my U.S. Pat. No. 5,469,901, the anvil of a disc chipping machine is located at the base of an infeed spout so that wood, usually in the form of tree limbs, is presented directly to the hammer/anvil interface as it is fed into the machine. In this way, the wood that is introduced through the infeed spout is immediately shredded and torn by the scissor action of the interacting hammers and anvil.

In the past, hammers such as those just discussed have generally been rectangular and have been formed of a single piece of hardened steel and anvils have been formed from a hardened steel bar having square transverse slots or grooves through which the hammers pass cut in one edge thereof. While this has proved somewhat acceptable for shredding and cutting wood, it nevertheless is plagued with various problems and shortcomings. For example, in disc-type chippers, a relatively large clearance must be provided in the slots of the anvil so that the rectangular hammers, which are actually traveling in circles, can pass through the slots in the anvil without engaging the sides thereof. This problem is particularly acute at positions nearest the hub of the disc, where the arc through which the hammers travel is the tightest. An additional problem with prior art wood chippers and hogs has been that the anvils generally are made of a single solid piece of hardened steel that is securely fastened to the frame of the machine adjacent to the rotating disc thereof. Such monolithic anvil designs, which have been relatively simple to manufacture, are nevertheless plagued with their own problems. For example, occasionally a stone or piece of metal will inadvertently be fed into the machine. Such foreign items can cause teeth of the anvil to be broken off when they encounter the interface between a moving hammer and an anvil slot. Broken anvil teeth reduce the efficiency of the entire machine and require that the anvil be replaced. In addition, anvils in wood chippers and wood hogs tend to wear at different rates along their length as a function of the distance along the anvil from the hub of the chipper. Accordingly, in some instances, the entire anvil must be replaced when only a portion of it is worn beyond use. Obviously, this is expensive and wasteful.

It has also been known in the past to provide disc and/or drum chippers and hogs with chip sizing grates for insuring that wood chips and shards expelled from the machine are of a predetermined maximum size. Examples of such grates are illustrated in my own U.S. Pat. No. 5,469,901 and in other U.S. patents including U.S. Pat. Nos. 4,802,631 of Arasmith and 4,958,775 of Arasmith. U.S. Pat. No. 4,077,450 of Ackerman illustrates a rotating drum chipper having holes or gullets formed in the drum through which wood chips pass as they are cut. However, this does not function to size the chips themselves but only to direct them away from the cutters as the wood is processed. Many prior art chip sizing grates have been relatively primitive and have simply comprised metal plates adjacent the cutting surface of the machine with holes formed in the plates for passing chips and shards when they reach a certain small size. Therefore, they have generally been limited in their function and generally serve as simple sieves for sorting chips into various sizes.

The inner surfaces of chip sizing grates are subjected during use to extreme abuse because of the violent and often abrasive nature of the cutting and tearing of wood by the hammers or knives.

Further, in grates such as that shown in Arasmith ('775) wherein gullets in the grate are provided with cutting or tearing surfaces, wood shards are forcibly engaged by these surfaces and directed through the gullets in the grate, which deteriorates and wears out the cutters and the gullet openings and can break off the cutters. For these and other reasons, chip sizing grates generally are subject to frequent and expensive replacement and repair.

In the past, foramanous chip sizing grates such as those discussed above have generally been designed to follow the contour of the cutting surface (be it a disc or drum surface) and to be fixed at constant spacing therefrom. While this has proved somewhat acceptable for shredding and cutting wood and sizing the resulting chips, it nevertheless is plagued with various problems and shortcomings. Certain designs of wood shredding machines, for example, utilize hammers of different protruding heights to break down wood or other materials into a smaller finished product. As a result, the path of hammers having the smallest protrusion from the rotating surface is significantly further away from the inner surface of the chip sizing grate than the path of the taller hammers. This creates voids in which material can become lodged, ultimately clogging the machine. In addition, since the edges or end faces of the gullets in the grate act to help cut and process the wood as the hammers pass the gullets, the hammers that are further from the grate do not cooperate efficiently with the gullets in the grate, resulting in less efficient overall machine operation.

Another problem, particularly with disc-type wood hogs, is that broken down wooden material tends to be slung by centrifugal force toward the outside peripheral portion of the rotating disc. While hammers and cutters actually move faster in these regions, the power required to break down wood here is significantly greater. In many instances, it is more efficient for the wood to be retained in a region closer to the hub of the disc until it is broken down into finer chips and shards and then moved to the peripheral portion of the disc for further processing.

Finally, a general problem with all types of wood chippers and hogs has been various voids in the spaces between the hammers or cutters on a rotating surface and the inner surfaces of the housing or grate. These voids occur, as mentioned above, partially because of different size hammers on the rotating surface with the inner surface of the grate necessarily being spaced from the surface a distance to accommodate the larger hammers. Voids also occur between the individual hammers in a series of aligned hammers, whether the hammers be short hammers or tall hammers. The most efficient processing occurs when the occurrence of voids of all types is minimized. The prior art has heretofore failed to address this general problem.

It will thus be seen that there exists a continuing need for a wood pulverizing machine such as a chipper or hog having improved hammer and anvil configurations designed to enhance the efficiency and function of the machine. Such hammer and anvil configurations should assure minimum clearance between the walls of the anvil slots and the hammers passing through to maximize the scissor-like action that shreds wood into chips and shards within the machine. In addition, an improved anvil design should permit placement of the anvil adjacent a hammer-bearing disc in any one of a variety of orientations relative to the radius of the disc to improve efficiency. Further, the anvil should be assembled in replaceable segments so that broken teeth of an anvil can be replaced without replacing the entire anvil.

Improved chip sizing grates and grate components are also needed. Such grates should cooperate efficiently with the rotating cutting or shredding surfaces of the machine, should be highly resistant to wear, tear, and breakage, should help prevent wood shards from being slung to the peripheral portions of a rotating disc too soon, and should be easy and simple to overhaul when necessary. There is a general need for a wood chipper or shredder in which the occurrence of voids in regions where wood is processed is reduced to a minimum. It is to the provision of a wood pulverizing machine having such improved hammer and anvil configurations, improved grates and grate components, and minimized voids that the present invention is primarily directed.

SUMMARY OF THE INVENTION

Briefly described, the present invention comprises a wood pulverizing machine such as a disc hog having greatly improved hammers and anvil configurations and improved grates for providing more efficient and effective pulverization of wood such as limbs and the like. The improved hammer and anvil designs of the present invention are primarily intended for use with disc hogs; however, the concepts disclosed herein are also applicable to drum chippers having cylindrical drums with hammer studded surfaces.

In one embodiment, the present invention comprises an anvil/hammer combination wherein the hammers are curved to correspond roughly to the radius of curvature at the location of the hammer on the disc. Correspondingly, the slots formed in the anvils, through which the hammers pass, are curved to correspond to the curvature of the hammers. In this way, the space between the moving hammers and the slots in the anvils can be minimized to increase the pulverizing efficiency of the machine. The improved anvils of the present invention have slots formed to accommodate anvils positioned either along a radius or skewed relative to a radius of the disc, even to the point of being perpendicular to a radius.

Preferably, the anvils of this invention have one or more useable edges or surfaces so that the anvil can be removed and turned over or repositioned to present fresh slots and cutting surfaces to the hammers and the disc of the machine. In this way, the anvil, when worn, can simply be turned over to present a fresh cutting edge, thus prolonging the life of the anvil.

In one preferred embodiment, the anvil is formed from a series of anvil segments bolted together to form the elongated anvil. With this embodiment, if one tooth of the anvil should become broken or unacceptably worn, only the single anvil element requires replacing, thus increasing the efficiency and economy of the machine as a whole. Each anvil segment is formed with a tooth and a shoulder that aligns with the shoulder of an adjacent anvil segment to define a slot through which a moving hammer can pass. The anvil segments have alignment means so that they are automatically aligning when secured together to form the entire anvil structure.

The invention further comprises an improved disc hog-type wood chipper having a first anvil aligned along a first predetermined orientation relative to the disc radius and a second anvil oriented along a second predetermined orientation. In the preferred embodiment, the anvils are aligned along a radius and perpendicular to a radius on the bottom and side of the infeed spout. In this way, the shredding, tearing, and pulverizing process is greatly enhanced over prior art designs.

The invention also comprises improved chip sizing grates and devices for minimizing voids in the wood processing regions of the machine. One embodiment includes chip sizing grates that are skewed relative to the adjacent rotating surface of the machine. That is, the grate is not maintained at a constant distance from the rotating surface but rather is closer to the surface in some locations than in others. In the case of a disc hog, such a grate can take the general shape of a cone, either being closer to the disc at its center or closer to the disc at its perimeter. This configuration in conjunction with correspondingly sized hammers results in better material control and more efficient processing and can be applied both to disc hogs and drum-type chippers.

The invention also contemplates grate rings used with and without rotor rings (i.e. rings on a disc or a drum) to minimize voids in regions of the machine where wood is processed. Rotor rings, for example, can fill the voids between individual hammers along a hammer path. Grate rings function to fill the voids between the interior surface of the grate and shorter hammers on the rotating surface. The interior surface of the grate itself is lined, according to one aspect of this invention, with a grate liner formed from a large number of removable and replaceable grate ring segments. The grate ring segments are designed to be replaced when they become worn to reduce the expense and maintenance time required to replace an entire grate when worn beyond use. The grate rings also cooperate, in one embodiment, with the holes or gullets in the grate to form relatively sharpened cutting edges that, in conjunction with the moving hammers, improve the shredding efficiency and overall function of the machine. Alternatively, reversible and replaceable gullet liners can be provided so that only they need to be replaced when worn rather than the entire grate liner. Any combination of these elements can be provided as desired.

Thus, it is an object of the invention to provide an improved hammer and anvil design useable in conjunction with a wood pulverizing machine to increase the efficiency of the machine.

It is another object of the invention to provide an improved anvil design for use with a wood pulverizing machine wherein the anvil has at least two useable surfaces for increased anvil life.

An additional object of the invention is to provide an improved anvil for use with a wood pulverizing machine wherein the anvil is formed of a series of anvil segments interconnected together so that individual segments can be removed and replaced if desired.

Another object of the invention is to provide an improved design for hammers useable with a disc hog-type wood pulverizing machine wherein the hammers are curved to correspond to a radius of the disc and wherein the slots formed in the anvil are also curved to accommodate the curved hammers.

A further object of the invention is to provide an improved disc hog-type wood pulverizing machine having at least two anvils oriented along selected perimeters of the machines infeed port to provide increased wood pulverizing efficiency.

An additional object of the invention is to improve the efficiency of chippers and shredders by filling the voids in regions where wood shredding and processing takes place.

Another object of the invention is to provide a grate liner that can be replaced easily when worn.

It is an object of the invention to provide grate rings and rotor rings and to combine such rings to fill voids in the wood processing regions of the machine.

A further object of the invention is to provide grates that are skewed relative to the rotating disc or drum of a wood processing machine to aid in controlling material flow within the machine to improve the processing efficiency thereof.

These and other objects, features, and advantages of the invention will become more apparent upon review of the detailed description set forth below taken in conjunction with the accompanying drawings, which are briefly described as follows.

DETAILED DESCRIPTION OF THE PREFERRED EMBODIMENT

Figure 1A:
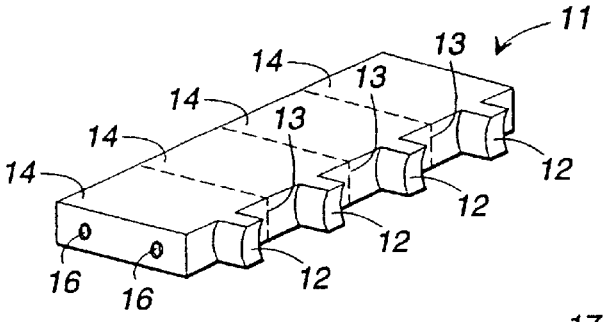
FIG. 1A is a perspective view of an improved anvil that embodies principles of the preset invention in a preferred form.

Referring now in more detail to the drawings, in which like numerals refer to like parts throughout the several views, FIGS. 1A through 1D illustrate anvils for use with disc hog-type wood chippers with the anvils embodying principles of the present invention in preferred forms. FIG. 1A illustrates a simple one-sided anvil formed with curved teeth and slots to accommodate the passage of hammers on an adjacent rotating disc. The anvil 11 has an elongated generally rectangular shape with a series of protruding teeth 12 formed along one edge thereof. Separating the teeth 12 are a set of slots 13. As described in more detail below, the anvil 11 is adapted to be mounted to a disc hog-type wood pulverizing machine with its teeth 12 extending toward the surface of the rotating disc of the machine and with its slots 13 positioned so that hammers protruding from the surface of the disc pass through the slots. The action of the hammers and slots functions to tear and shred wood into chips and shards for subsequent processing or other use.

The anvil 11 in FIG. 1A is also seen to be formed by a series of anvil segments 14. The segments 14 are aligned edge to edge and are secured firmly together by a pair of bolts 16 to form a substantially monolithic anvil structure. Formation of the anvil 11 from a series of anvil segments permits easy and economic replacement of single segments in the event that the tooth associated with a segment becomes broken, damaged, or worn beyond use. This represents a benefit over prior art anvils made of a single piece of metal wherein the entire anvil must be replaced if any portion thereof is damaged.

Figure 1B:
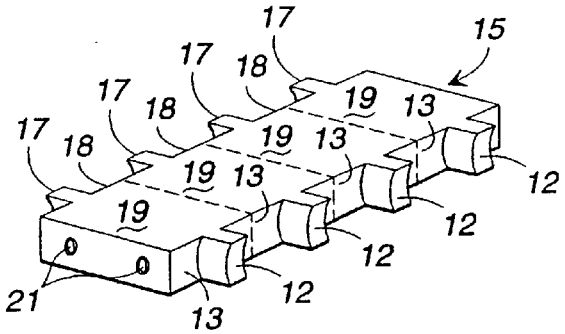
FIG. 1B is illustrates an alternate embodiment of the anvil of FIG. 1A illustrating an anvil with two useable edges.

FIG. 1B illustrates an anvil with teeth and slots formed along two opposed edges thereof. Specifically, a series of teeth 12 are formed along one edge defining slots 13 therebetween and a corresponding series of teeth 17 defining slots 18 are formed along the opposed edge of the anvil 15. As with the embodiment of FIG. 1A, the anvil of FIG. 1B is also formed by a series of side by side anvil segments 19 that are bolted together with a pair of bolts 21. With the embodiment of FIG. 1B, should the teeth and slots on one edge become worn or broken, the entire anvil 15 can be removed, rotated 180 degrees, and reinstalled to present fresh teeth and grooves to the rotating disc of a disc hog machine. Alternatively, if one of the teeth on one edge of the anvil should become broken, the anvil can be removed, disassembled, and the affected segment rotated 180 degrees. The anvil can then be reinstalled so that a fresh tooth is presented in place of the broken tooth. Should both teeth of a particular segment become broken or worn beyond use, it is only necessary to replace one segment rather than the entire anvil to bring the machine back to operating standards.

Figure 1C:
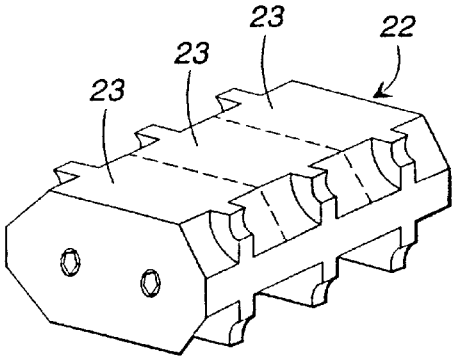
FIG. 1C is a perspective view of an anvil embodying principles of the present invention and intended for use with a drum-type wood chipping machine.

FIG. 1C illustrates an anvil for use with a rotating drum-type wood pulverizing machine. With this embodiment, the anvil 22 is formed from a series of bolted together anvil segments 23. The segments are formed so that, when they are bolted together, they define four sets of teeth and slots that can be presented to the surface of a rotating drum to accommodate the passing hammers or knives on the drum. With this embodiment, should a set of teeth become worn or broken, the anvil can be rotated and reinstalled with a fresh set of teeth presented to the drum. This can be done up to three times. In addition, individual segments can be removed and replaced or rotated if necessary to present fresh teeth and slots to the rotating drum surface.

Figure 1D:
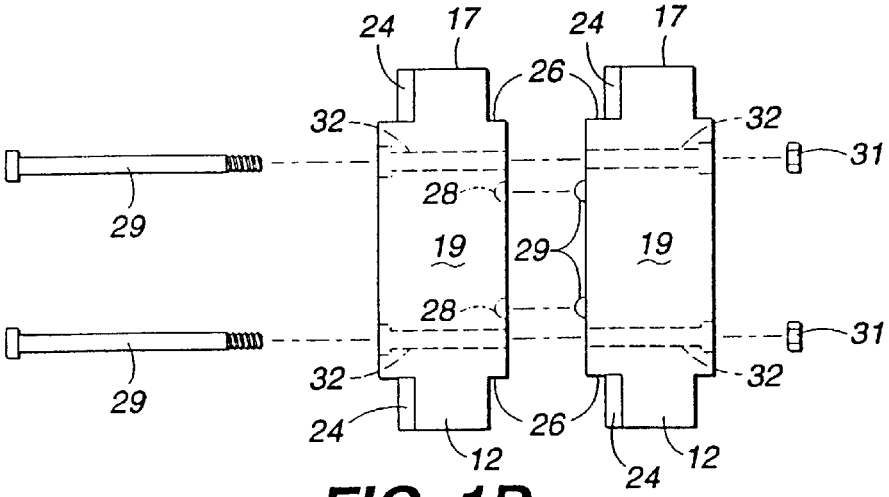
FIG. 1D illustrates formation of an anvil of the present invention from anvil segments connected together with bolts.

FIG. 1D illustrates one preferred method of securing anvil segments together to define an anvil. The embodiment shown in FIG. 1D corresponds to the anvil shown in FIG. 1B; however, it will be understood that the configuration illustrated in FIG. 1D is applicable to any of the other anvil designs disclosed in this application. Each of the anvil segments 19 is formed with a tooth 17 on one end and an opposing tooth 12 on the other end. The teeth 12 and 17 are curved to accommodate a moving hammer of a rotating disc and the curved protruding sides of the teeth are visible at 24. The teeth 12 and 17 define shoulders 26. When two segments 19 are secured together as illustrated in FIG. 1B, the shoulders 26 of adjacent segments along with the walls of adjacent teeth form the slots 13 and 18 between the teeth as shown in FIG. 1B.

A pair of alignment pins 27 are formed along one edge of segment 19. The alignment pins 27 are sized and positioned to be received in a pair of corresponding alignment dimples 28 formed in the facing edge of the adjacent anvil segment 19. In this way, when two segments 19 are brought together, they are automatically aligned with each other by means of the alignment pins 27 and dimples 28.

Pairs of through bores 32 are formed in the segments and are positioned to align with each other and to receive a pair of bolts 29 and nuts 31 for securing the two segments together side by side to define a composite anvil. Naturally, in use, several of the segments 19 would be bolted together to form a long anvil having a series of teeth and slots. Only two anvil segments 19 are illustrated in FIG. 1D for clarity and simplicity of discussion.

Figure 2:
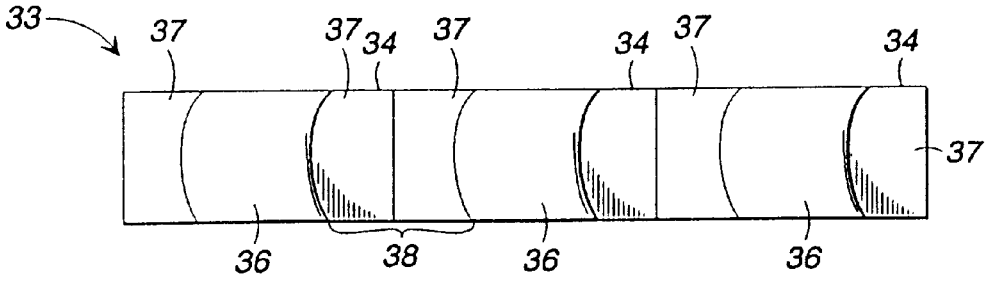
FIG. 2 is an edge elevational view illustrating the curved teeth and slots formed in an anvil designed to be oriented along a radius of a disc hog.

FIG. 2 is a side elevational view of an anvil that embodies principles of this invention in a preferred form. The anvil 33 is seen to be formed from a series of bolted together anvil segments 34. Each segment 34 has a protruding tooth 36 and a pair of shoulders 37 that, in conjunction with the shoulders of adjacent segments, define slots 38 between adjacent teeth 36. The teeth 36 and therefore the slots 38 are curved in order to accommodate the circular path take by a hammer on a rotating disc of a disc hog-type wood pulverizer. In the embodiment of FIG. 2, the anvil 33 is adapted to be oriented substantially along a radius of the disc. Thus, the curvature of each tooth corresponds to the radius of curvature of the disc at the position where the tooth is located. With the curved teeth and curved slot configuration shown in FIG. 2, a much closer clearance can be provided between a moving hammer and the slot through which it passes to enhance the efficiency of the wood pulverization process.

Figure 3:
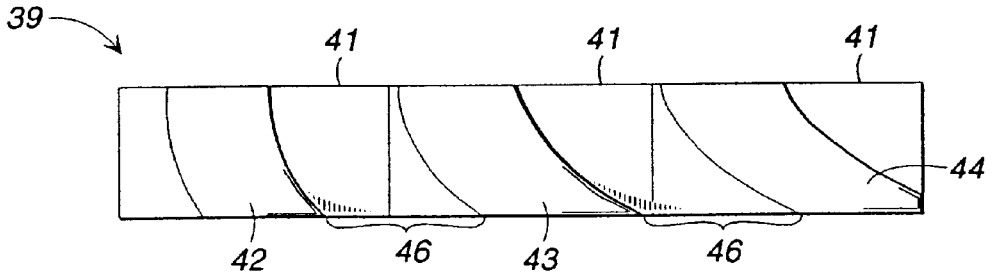
FIG. 3 is a side elevational view of an anvil adapted to be positioned in a skewed orientation relative to a radius of a wood chipper disc.

FIG. 3 illustrates an anvil that embodies principles of the present invention and that is designed to be oriented at a skewed angle relative to a radius of a rotating disc with which the anvil is used. As with previous embodiments, the anvil 39 is formed by a series of bolted together anvil segments 41. Each segment is formed with a tooth 42, 43, and 44 respectively. Since the anvil 39 of FIG. 3 is adapted to be positioned in skewed relationship with respect to a radius of its associated rotating disc, the teeth 42, 43, and 44 are progressively skewed to correspond to the radius of curvature at the position on the disc where the tooth is located. With this configuration, the slots 46 defined between the teeth 43 and through which the hammers on the rotating disc pass, are also progressively skewed to accommodate the path of the moving hammers on the disc.

Figure 4A:
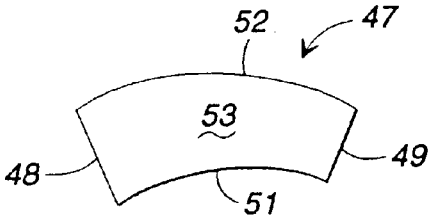
FIGS. 4A through 6B illustrate various improved hammer designs for use with disc hog-type wood pulverizing machines.
Figure 4B:
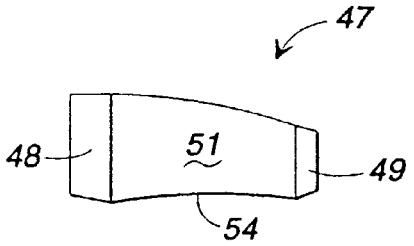

FIGS. 4A and 4B illustrate from the top and side respectively, one configuration of a hammer for use with a corresponding anvil of the present invention. The hammer 47 is seen to have a front surface 48, a rear surface 49, an inner side surface 51, an outer side surface 52, and a top surface 53. The hammer 47 is adapted to be secured at its base 54 to the disc of a disc hog-type wood pulverizing machine with appropriate attachment means such as a bolt or by welding. The hammer 47 of FIGS. 4A and 4B is seen to be inwardly tapered from side to side and along its top from its front surface 48 to its back surface 49. In addition, the hammer 47 is curved to correspond to the radius of curvature at the position on the disc where the hammer is to be located. The size of the front surface 48 of the hammer 47 is selected to be just smaller than the size of a slot 38 (FIG. 2) in an associated anvil so that the clearance between the moving hammer and the slot is small. The curved and tapered shape of the hammer 47 accommodates the movement of the hammer through the slot and further enhances the scissor action as the front surface 48 of the hammer passes through the slot 38.

Figure 5A:
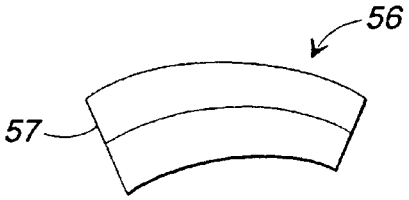
Figure 5B:
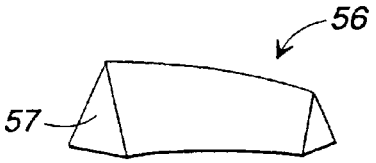

FIGS. 5A and 5B illustrate an alternate hammer having a triangular configuration. As with the hammer of FIGS. 4A and 4B, the triangular hammer 56 has a curved tapered configuration with a triangular shaped front surface 57. The hammer of FIGS. 5A and 5B is for use in conjunction with an anvil having triangular shaped slots formed between corresponding teeth.

Figure 6A:
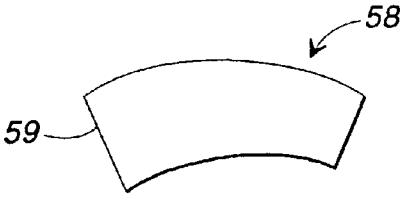
Figure 6B:
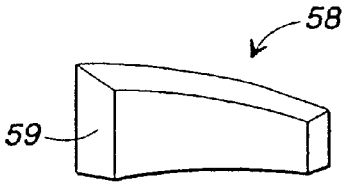
Figure 7A:
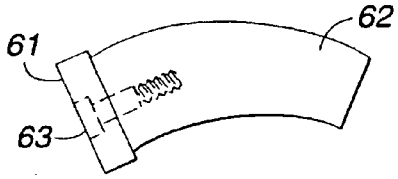
FIGS. 7A through 9B illustrate alternate embodiments of hammers designed for use with disc hog-type wood pulverizing machines.
Figure 7B:
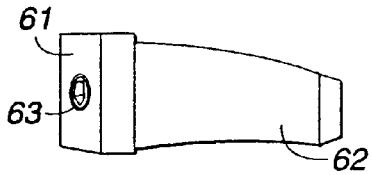
Figure 8A:
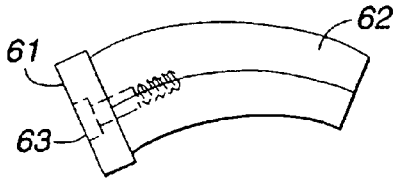
Figure 8B:
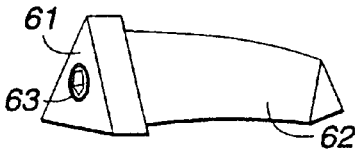
Figure 9A:
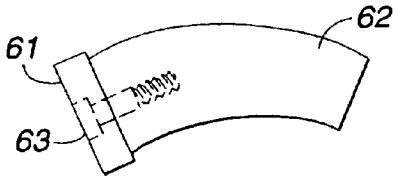
Figure 9B:
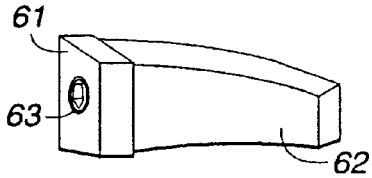

FIGS. 6A and 6B illustrate still another embodiment of a hammer 58 wherein the front surface 59 of the hammer has a trapezoidal shape, being taller along the outside edge of the hammer than along the inside edge of the hammer. As with the previously discussed hammers, the hammer of FIG. 6A and 6B is curved and tapered and is intended to be used with a corresponding anvil having slots that match the trapezoidal shape of the front surface of the hammer.

FIGS. 7A through 9B illustrate alternate embodiments of the hammers shown in FIGS. 4A through 6B respectively. The function of these hammers is the same as that of the previously described hammers except that the hammers of FIGS. 7A through 9B each comprise a body that is welded to the rotating disc and a removable front surface that can be made of carbon steel or other hard material. The advantage of the hammers of FIGS. 7A through 9B is that the front or cutting surface of the hammers can be replaced if worn or broken. Each of the front or cutting surfaces 61 is secured to its corresponding hammer body 62 by means of a bolt 63. With this embodiment, the hammer body 62 can be permanently fixed to the disc with weld joints so that only the front or cutting surfaces 61 need to be replaced when worn.

Figure 10:
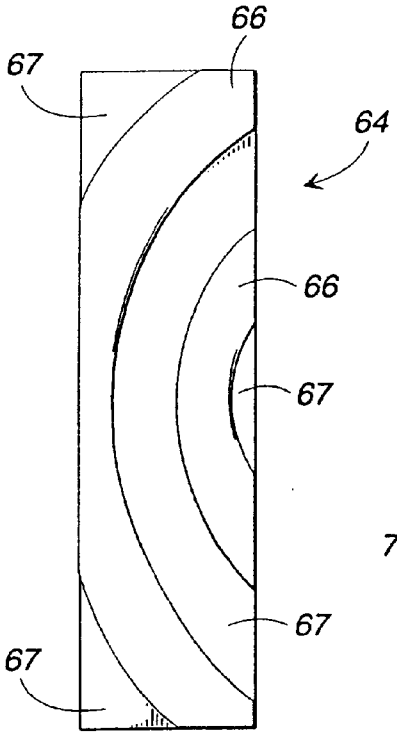
FIG. 10 is an edge elevational view of the teeth and grooves of an anvil adapted to be oriented perpendicular to the radius of a disc hog disc.

FIG. 10 is an edge elevational view of an anvil 64 adapted to be oriented along a line perpendicular to a radius of the rotating disc of a disc hog-type wood pulverizing machine. In this embodiment, the teeth 66 and corresponding slots 67 are seen to be configured to accommodate the hammers on the rotating disc when the anvil is oriented perpendicular to a radius. Obviously, any configuration of hammers and slots between the configuration shown in FIG. 2 and that shown in FIG. 10 is possible, depending upon the position where an anvil will be located and the orientation of the anvil relative to a radius of the disc.

Figure 11:
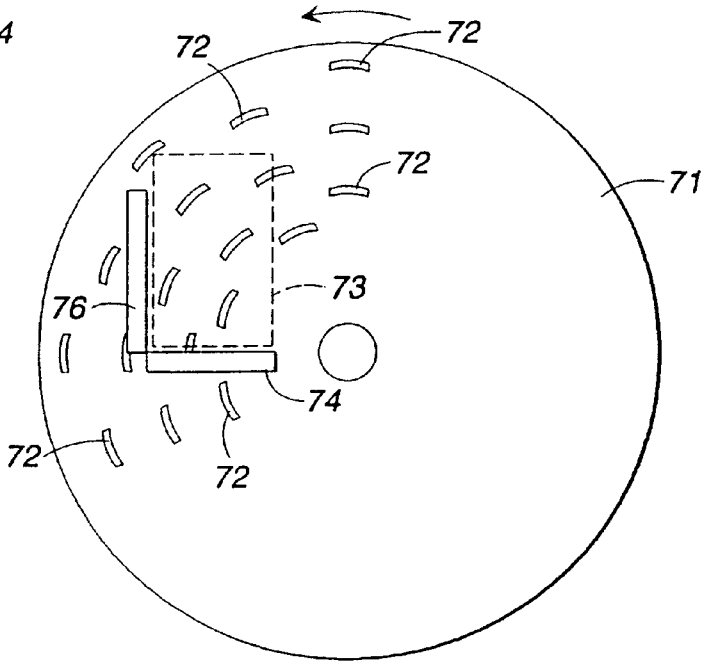
FIG. 11 illustrates an improved disc hog-type wood pulverizing machine having curved hammers and two anvils oriented along selected perimeters of the infeed spout of the machine.

FIG. 11 illustrates a wood pulverizing machine in the form of a disc hog that embodies principles of the present invention in a preferred form. For simplicity, only the disc, hammers, anvils, and infeed spout are shown in FIG. 11. Other functional components of a disc hog-type wood pulverizing machine, such as the housing, are illustrated in my U.S. Pat. No. 5,469,901 and are well known in the art. In FIG. 11, the rotating disc 71 of the disc hog pulverizing machine is see to be studded with a plurality of protruding hammers 72 arrayed about its hub. The hammers 72 can take on any of the configurations illustrated in FIGS. 4A through 6B or FIGS. 7A through 9B or can take on other configurations according to the intended use of the machine. An infeed spout 73 is indicated in phantom lines in FIG. 11. In use, the infeed spout would be mounted to the front wall of the housing of the disc hog and would provide a feeder opening through which limbs and other lumber to be pulverized could be inserted.

A first anvil 74 is mounted to the housing of the machine at the base of the infeed spout 73. In the embodiment of FIG. 11, the anvil 74 is oriented substantially along a radius of the disc and thus would have teeth and slots shaped substantially as shown in FIGS. 1A, 1B, and 2. The slots formed in the anvil 74 are positioned to accommodate the hammers 72 which pass through the slots to shred and shard the wood as previously described.

A second anvil 76 is positioned along one side of the infeed spout 73 and is oriented substantially perpendicular to a radius of the disc 71. As with the anvil 74, the slots and teeth formed in the anvil 76 are positioned and oriented to accommodate the movement of the hammer 72 past the anvil 76 and through the slots formed therein. With the embodiment of FIG. 11, as wood in the form of limbs or otherwise, is fed into the infeed spout 73, it is engaged by the hammer 72, which tears and cuts the wood against both the radially oriented anvil 74 and the perpendicularly oriented anvil 76. The efficiency of the pulverization process is thus enhanced by the addition of a second anvil oriented ar right angles with respect to the first anvil. Clearly, a third anvil could also be added along the other side of the inlet spout 73 and other anvils could be added as desired around the periphery of the rotating disc 71 to further tear and shard the wood as it is carried about the disc.

FIGS. 12 through 20 illustrate aspects of the present invention related to improved grates and grate components as well as grate rings and drum or disc rings (collectively referred to as rotor rings) for filling voids in wood processing regions of hogs and chippers.

Figure 12:
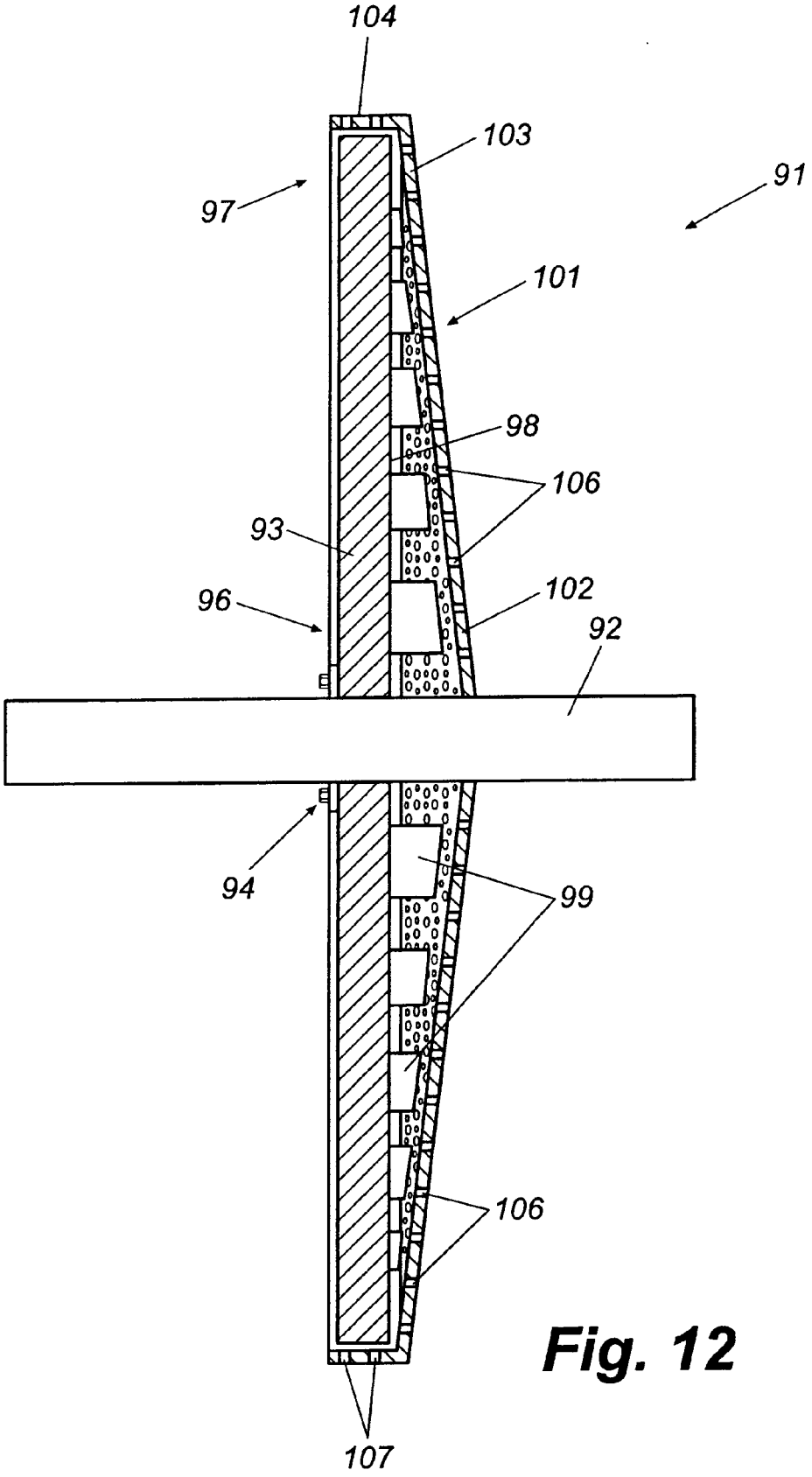
FIG. 12 is a simplified cross sectional view of a rotating disc wood pulverizer having a grate that embodies principles of this invention in a preferred form.

FIG. 12 illustrates a disc hog 91 comprising a shaft 92 to which a rotating disc 93 is mounted by means of collars and bolts 94 or any other appropriate means of mounting the disc to the shaft. It will be understood that the entire mechanism preferably is mounted on a frame with appropriate housings, drive motors, infeed chutes, and drive linkages as commonly known to those of skill in the art. These components do not form a part of the present invention and have been omitted from FIGS. 12 through 20 in order to illustrate and describe the invention with precision and clarity.

The disc 93 has a central or hub portion 96 and a peripheral portion 97. The front face 98 of the rotating disc 93 is provided with arrays of protrusions 99, which, in FIG. 12 take the form of hammers, for impacting, pulverizing, and shredding wood presented to them and reducing the wood to small pieces and shards. It will be understood that the protrusions need not necessarily be hammers, but could also be other types of protrusions appropriate to a desired end product consistency. For example, knives and/or knives in combination with gullets formed through the disc could be used in the event it is desired to reduce wood to shavings rather than pulverized chips and shards.

In the embodiment of FIG. 12, the protrusions 99 project different distances from the front surface 98 of the rotating disc 93. Specifically, arrays of relatively tall hammers are located in the hub region 96 of the rotating disc and the hammers become relatively shorter toward the peripheral region 97 of the disc. This configuration has been found to be advantageous for a number of reasons. For example, since the taller hammers in the hub region of the disc rotate slower than the shorter hammers in the peripheral region of the disc, and because they are taller and thus present more aggressive impacting surfaces to wood presented thereto, they tend to be more efficient in the initial phases of wood pulverization where the wood is being torn and shredded from logs or other large pieces of lumber. This is aided by the fact that, because of the relatively short distance of these hammers from the shaft 92, the drive system produces more torque or force in regions where the taller hammers are arrayed. On the other hand, the shorter hammers in the peripheral region of the disc move significantly faster than the taller hammers because of their greater distance from the shaft 92 but present shorter less aggressive impacting surfaces to the wood. Accordingly, the shorter hammers in the peripheral regions of the disc are more efficient for reducing larger wood shards and pieces to smaller chips and shards. The disc hog 91 thus acts essentially as a dual zone processor wherein logs are feed to the central region of the disc where initial shredding is accomplished by the taller hammers and as these shards are moved toward the peripheral regions of the disc by centrifugal force, they are reduced to smaller and smaller chips and shards by the progressively shorter hammers.

A shallow-angle cone-shaped chip sizing grate 101 is mounted adjacent to and spaced from the front surface 98 of the rotating disc 93. The grate 101 is spaced further from the surface 98 of the disc 93 at the hub portion 96 of the disc than it is at the peripheral portion 97 thereof. With this configuration, the inner surface of the grate 101 substantially follows the progressively decreasing height of the hammers 99 from the hub portion 96 of the disc toward the peripheral portion 97 thereof, although this is not necessarily a requirement of the invention. The grate 101 is provided with an array of holes or gullets 106 that are sized to pass wood chips and shards of a predetermined maximum size. Accordingly, as wood is processed by the hammers between the disc and the grate, chips and shards reduced to a size corresponding to the size of the gullets 106 pass through the grate for collection. If desired, the gullets can be of different sizes such as, for example, larger near the hub portion of the disc and smaller near the peripheral portion, in order to pass chips and shards having a range of maximum sizes.

Preferably, an annular rim 104 extends around the periphery of the grate 101 and encircles the peripheral edge of the disc 101. The rim 104 is also provided with holes 107 in order to pass chips and shards that may fall into this region of the apparatus. Although not shown in FIG. 12, small hammers or knives could be provided around the peripheral edge of the disc 101 if desired to process the wood chips further as they fall into the space between the peripheral edge of the disc and the rim 104.

Figure 13:
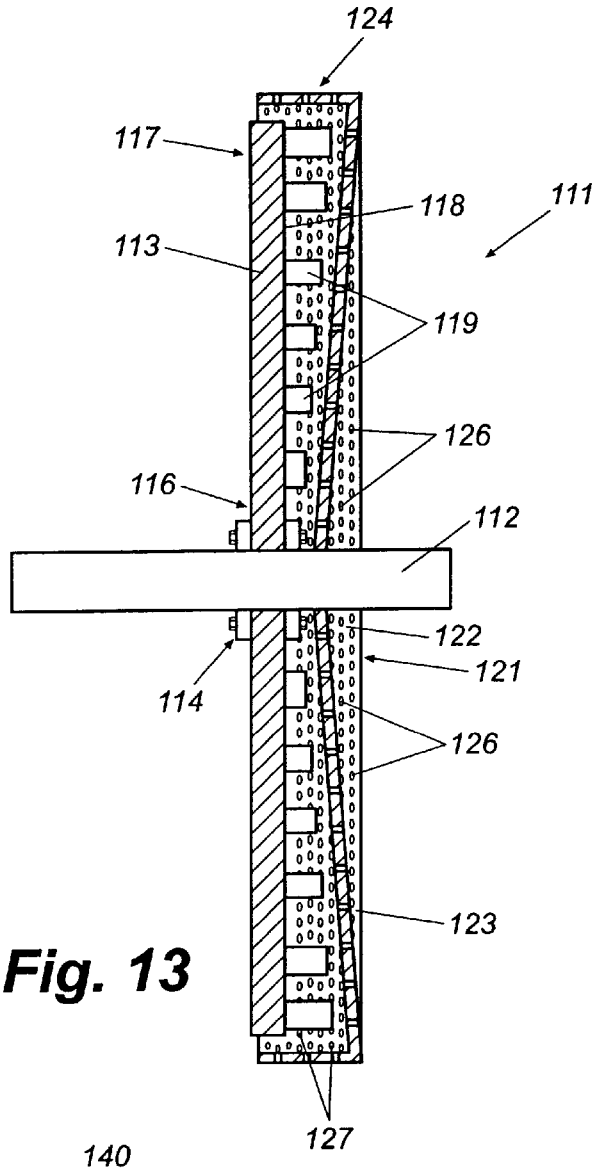
FIG. 13 is a simplified cross sectional view of a rotating disc wood pulverizer having a grate that embodies principles if the invention in an alternate preferred form.

FIG. 13 illustrates an alternate embodiment of the invention of FIG. 12. This embodiment comprises a shaft 112 to which a rotating disc 113 is mounted by collars and bolts 114 or other appropriate attaching means. The disc 113 has a front surface 118 to which an array of protrusions, in this case hammers 119, are mounted. The hammers 119 in this embodiment are relatively taller in the peripheral portion 117 of the disc and become progressively shorter toward the hub portion 116 thereof. A shallow-angle inverted cone-shaped chip sizing grate 121 is mounted adjacent to the front surface of the disc 113 and is spaced further from the surface at its peripheral portion 117 than at its hub portion 116. Again, the inner surface of the grate 121 substantially tracks the height of the hammers 119 as they become progressively shorter from the peripheral portion of the disc toward the hub portion thereof, although, again, this is not a requirement of the invention. As with the previous embodiment, the grate 121 is provided with an array of holes or gullets 126 sized to pass wood chips and shards of a predetermined maximum size as wood is processed in the space between the disc 113 and the grate 121. An annular rim 124 provided with holes 127 preferably extends around the periphery of the grate 121 and encircles the peripheral edge of the disc. Thus, the operative surfaces of the disc 113 are substantially enclosed within the chip sizing grate 121 and its peripheral rim 124 to confine wood chips and shards in this region until they have been reduced to a size small enough to pass through the holes and/or gullets formed in the grate and its rim.

Figure 14:
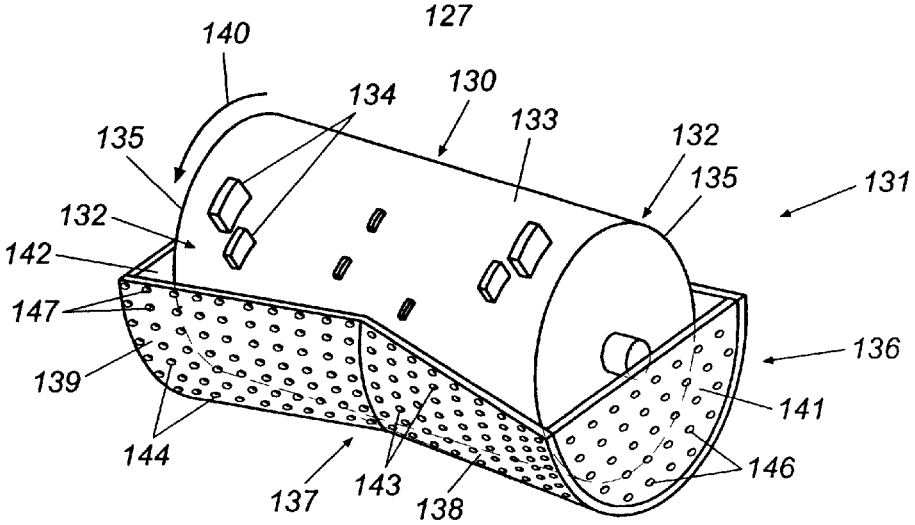
FIG. 14 is a simplified rotating drum wood pulverizer having a grate that embodies principles of the invention.

FIG. 14 illustrates the principles of the invention of FIGS. 12 and 13 applied to a drum-type wood processing machine or shreader. As with the previous embodiments, only the elements of the machine necessary to illustrate principles of the invention are shown for clarity. It will be understood by skilled artisans that a frame, drive shaft, drive motor, chute for delivering wood to the drum for processing, anvils, and other elements are present on a complete machine. These components are well known by those of skill in the art and thus are not included in the present description of the invention.

The drum shredder 131 comprises a disc-shaped rotating drum 132 mounted, in this case, for rotation in the direction of arrow 140. The drum 131 has a central portion 130 and end portion 132. An array of protrusions 134, which in this case are hammers but could also be cutting knives such as those shown in U.S. Pat. No. 4,802,631, are mounted to and arrayed on the surface of the drum 132. Preferably, but not necessarily, the hammers 134 are taller in the region of the end portion 132 of the drum and become progressively shorter toward the central portion 130 thereof. As mentioned above relative to disc chippers, this configuration provides advantages in many wood processing situations.

A chip sizing grate 136 at least partially encircles the drum 132 and at least encircles the lower portions of the drum where wood chips and shards naturally fall as they are processed in the space between the drum and the chip sizing grate. The grate could also extend further upwardly or a housing for carrying the infeed chute, anvils, and other components of the machine could be mounted to and extend upwardly from the chip sizing grate 136 to substantially enclose the drum 132.

The chip sizing grate 136 has a central portion 137, a right hand portion (as viewed in FIG. 14) 38, and a left hand portion 139. Preferably the right hand portion 138 is capped at its end with a crescent end plate 141 and, similarly, the left hand portion 139 is capped with a similar crescent end plate 142, thereby at least partially enclosing the ends of the drum to confine wood chips and shards in the region between the drum and the grate. In most cases, a portion of the housing (not shown) will extend upwardly from the end plates to enclose the drum within the machine.

The chip sizing grate 136, which may be referred to as a "V-grate" is closer to the surface of the drum 132 at its central portion and progressively diverges from the surface of the drum toward the end portions 132 thereof. As with the disc chippers of FIGS. 12 and 13, the inner surface of the V-grate generally follows the contour formed by the progressively taller hammers 134, although this not necessarily a requirement. The chip sizing V-grate is provided with arrays of holes or gullets 143 sized to pass wood chips and shards of a predetermined maximum size as the wood is shredded and processed by the hammers 134. The gullets 143 can be simple holes formed through the grate or, if desired, can be specially shaped gullets and/or can be provided with knife edge forming gullet liners as described in more detail below and as used in some prior art chippers such as that shown in U.S. Pat. No. 4,958,775 of Arasmith. Preferably, the gullets 143 are positioned to align with the paths of the hammers 134 as the hammers rotate around with the drum 132 so that the hammers pass over their respective aligned gullets as they move past the inner surface of the chip sizing grate 136.

The end plates 141 and 142 are also provided with holes or gullets 146 in the illustrated embodiment to pass chips and shards that may enter this region of the machine during processing. Holes in the end plates are desirable with the V-grate of this invention because wood chips and shards tend to migrate toward the ends of the grate as they are broken down. This is because of the generally downwardly sloping nature of the grate from its central portion 137 toward its end portions 138 and 139. In fact, this migration of chips and shards is one of the advantageous features of the V-grate design. Since natural migration occurs, hammers or knives or a combination of both having different wood processing characteristics can be provided at different longitudinal locations along the drum. For example, hammers designed for rough breakdown can be provided in the central portions of the drum while hammers and/or knives designed for finer breakdown can be provided at the end portions of the drum. As wood chips and shards migrate from the central portions of the grate to the end portions thereof, they are naturally broken down from larger chips and shards into progressively finer chips and shards that are discharged as end product through the gullets in the grate.

Figure 15:
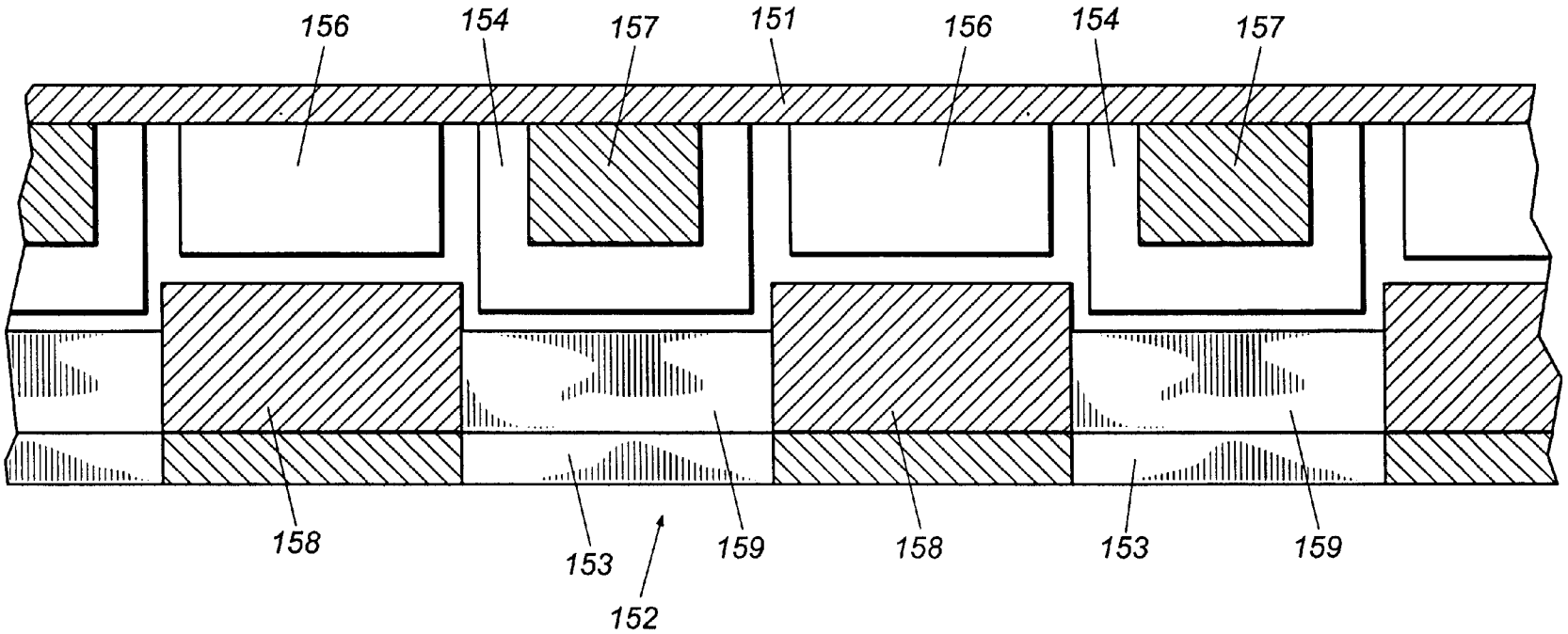
FIG. 15 is a cross sectional view of a section of a wood pulverizer showing the rotating surface of the pulverizer with hammers and an adjacent grate with grate rings according to principles of the invention.

FIG. 15 is a cross-sectional view of the region between the rotating drum or disc of a wood processing machine showing certain aspects of the invention in more detail. The rotating surface is designated by the reference numeral 151 and the grate is designated by the numeral 152. Protrusions, in this case hammers, are mounted to the rotating surface 151 for impacting and shredding wood presented to the surface. The hammers comprise sets of tall hammers 154 and sets of short hammers 156, which are arranged in FIG. 15 in alternating arrays on the disc. The hammers may also be arranged in other ways, such as, for example, in progressively increasing heights as illustrated in FIGS. 12 through 14. The chip sizing grate 152 is mounted in spaced relationship to the rotating surface and is provided with gullets 153 through which wood chips and shards of a predetermined maximum size pass as the wood is processed. The gullets are positioned to align with the paths of the respective hammers on the disc and the gullets that align with the short hammers 156 are, in this illustration, offset from the gullets that align with the tall hammers (and are therefore not visible in FIG. 15) although this is not necessarily a requirement. With this configuration, as wood shards are impacted by the hammers during processing, they are driven against the downstream ends or end walls of the gullets, which results in somewhat of a scissor action further tearing and cutting the shards into smaller pieces until they are sized to pass through the gullets and out of the machine.

In order to reduce voids between the surface of the rotating disc and the grate, rotor rings and grate rings are provided. The rotor rings 157 in FIG. 15 are mounted to the surface of the rotating disc and extend between successive ones of the taller hammers on the disc to fill the voids in these regions. Although not depicted in FIG. 15, rotor rings can also be provided between successive ones of the shorter hammers if desired to reduce voids in these regions. The grate rings are mounted to the inner surface of the chip sizing grate and comprise arrays of shorter grate rings 159 that extend between successive ones of the gullets aligned with the tall hammers on the rotating disc and function to reduce the void between the bottoms of the tall hammers and the grate. Each grate ring is formed by a series of grate ring segments, each segment being secured to the grate extending between two of the gullets in the grate. Taller grate rings 158, also defined by series of grate ring segments attached to the grate, are arranged in the paths of the short hammers on the rotating disc and reduce the void between the short hammers and the inner surface of the grate. Each of the shorter grate ring segments extends between a successive pair of gullets aligned with the tall hammers on the rotating disc. With this configuration, it will be seen that undesirable voids between the rotating disc and the chip sizing grate are substantially filled and reduced by the rotor rings and grate rings such that the most desirable spacing to provide efficient scissor action for breaking down the wood is maintained in all locations. Further, as discussed in more detail below, all of the grate ring segments together form a grate liner lining substantially the entire interior surface of the grate, which provides additional advantageous features.

Figure 16:
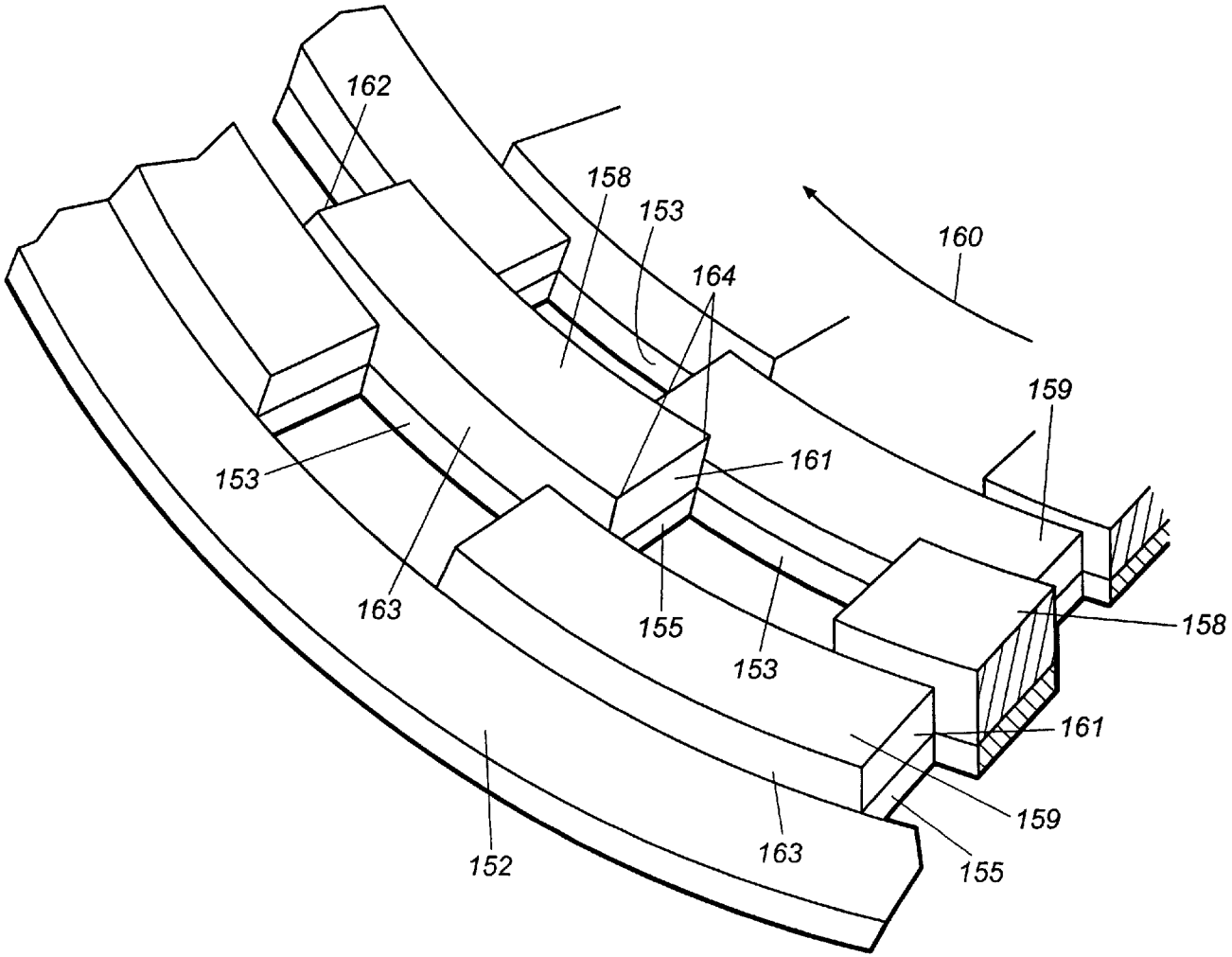
FIG. 16 is a perspective view of a grate for use with a rotating drum pulverizer with the grate being supplied with a grate liner according to principles of the invention.

FIG. 16 is a perspective view of a section of a chip sizing grate, in this case a grate for a drum shredder, provided with grate rings as discussed relative to FIG. 15. The grate 152 is provided with gullets 153 that are respectively aligned with the paths of hammers moving with the rotating drum in direction 160. The grate rings are each formed by a set of grate ring segments that each extend between successive pairs of gullets. Taller grate ring segments 158, which are aligned with the shorter hammers on the rotating drum, extend between successive ones of the gullets aligned with the paths of the shorter hammers. Similarly, shorter grate ring segments 159 extend between respective ones of the gullets aligned with the paths of the taller hammers on the rotating drum.

Each of the grate ring segments has an upstream end 161 that is substantially aligned with the downstream end 155 of an adjacent gullet 153. Further, because of the alternating placement of the shorter and taller grate rings, the taller grate ring segments define exposed relatively sharp corners 164 and sides 163, which are aligned with and form an extension of a side of the adjacent gullet in the tall hammer path. As discussed below, the upstream ends 161 of the grate ring segments can be fashioned to form blunt surfaces cutting surfaces, deflecting surfaces, or surfaces of other shape according to the desired nature of the shards and chips desired. The upstream ends of the grate ring segments and also the sharp exposed corners result in substantially improved cutting, tearing, and shredding efficiency, significantly improving the performance of the machine as a whole.

It will be apparent from FIG. 16 that the grate ring segments together define not only the grate rings but also form a grate liner that lines and covers substantially the entire inner surface of the grate. This is highly advantageous because the wear and tear and gradual deterioration of the grate that normally occurs is limited to the grate liner. The grate itself is protected by the grate liner from this abuse. Accordingly, when sufficient deterioration has occurred to require maintenance, only the grate ring segments need be replaced rather than replacing the entire grate of the machine. In the past, replacement of grates has been an expensive and time consuming project requiring that the entire machine be disassembled, the worn grate be removed, and an expensive new grate installed. With the present invention, the grate itself is left intact and only the grate ring segments are replaced during machine overhaul. An additional advantage is that grate ring segments with one upstream end configuration can easily be replaced with grate ring segments with a different upstream end configuration if desired to change the manner in which wood is processed by the machine and the nature of the end product thereof.

Figure 17:
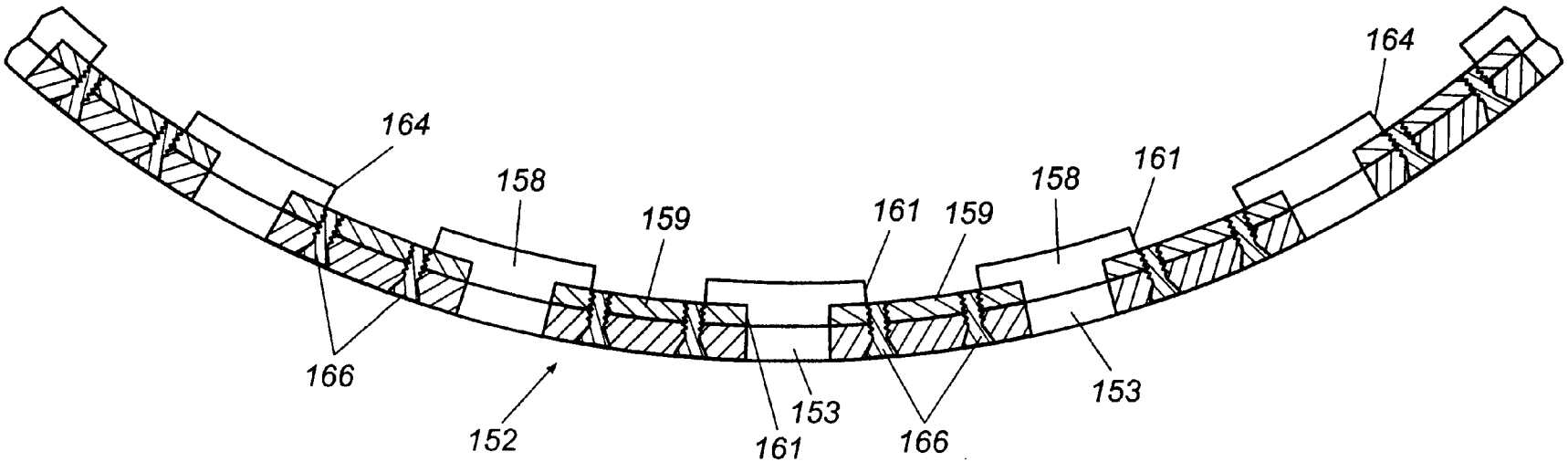
FIG. 17 is a cross sectional view of a portion of a grate showing a preferred attachment of the grate ring segments to the grate to form the grate rings and grate liner.

FIG. 17 is a cross-sectional view of a portion of a chip sizing grate provided with grate rings according to the present invention and illustrating one preferred method of attaching the grate ring segments to the grate. The grate 152 has gullets 153 with grate ring segments extending between successive gullets to form the grate rings and grate liner. Shorter grate ring segments are aligned with the paths of tall hammers and taller grate ring segments are aligned with the paths of short hammers. The grate ring segments have upstream ends 161 aligned with the downstream ends of their respective gullets. A pair of screws or bolts 166 attaches each of the grate ring segments to the grate and are removable from the outside of the grate for easy replacement of the segments when required. It will thus be seen that the grate ring segments and thus the entire grate liner formed thereby can be replaced simply by removing the grate ring segments and replacing them with new segments.

Figure 18:
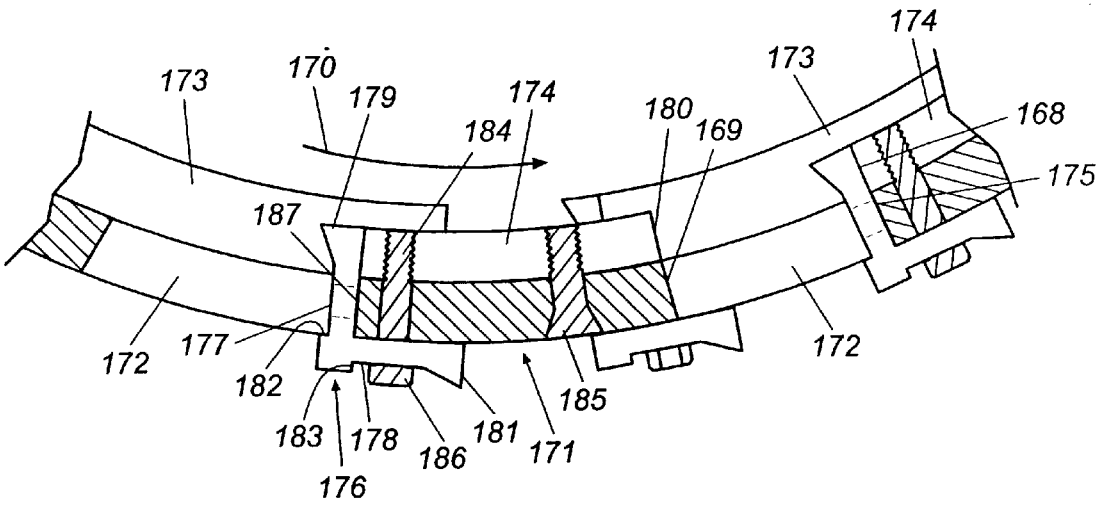
FIG. 18 is a cross sectional view of a portion of a drum grate with grate rings and reversible replaceable gullet liners according to the invention.
Figure 19:
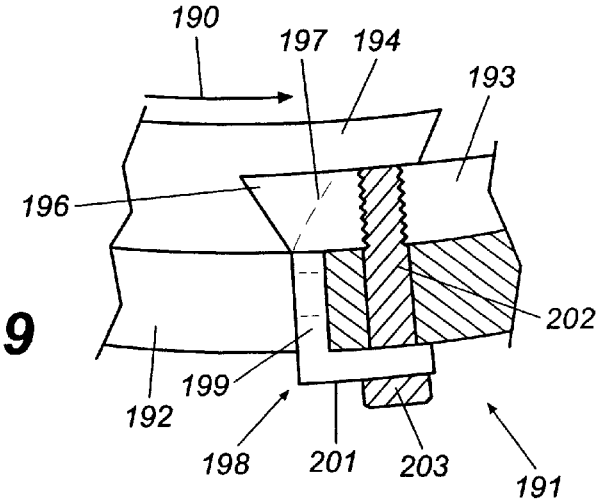
FIG. 19 is a cross sectional view of the edge portion of a grate gullet showing an alternate embodiment of a grate liner segment.
Figure 20:
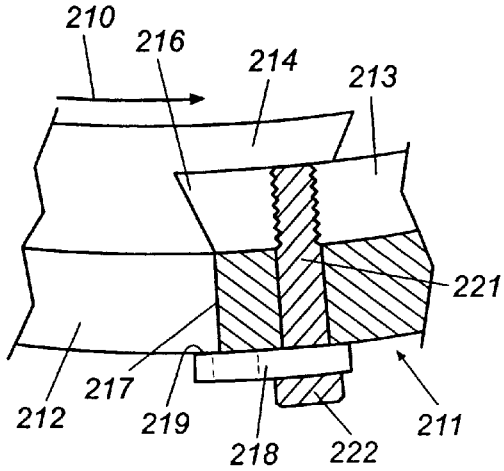
FIG. 20 is a cross sectional view of the edge portion of a grate gullet showing still another embodiment of a grate liner segment.

FIGS. 18 through 20 illustrate various embodiments of gullet liners and grate ring segments that, in combination, comprise a unique chip sizing grate assembly with substantial advantages over prior art grates. FIG. 18 illustrates a grate 171 provided with gullets 172 as previously described. Taller grate ring segments 173 extend between respective gullets in the path of short hammers (or knives) and shorter grate ring segments extend between successive gullets in the path of tall hammers (or knives). The gullets have upstream ends 169 and downstream ends 175 (relative to the direction of motion 170 of an adjacent rotating surface) and the grate ring segments have corresponding upstream ends 168 and downstream ends 180. In the embodiment of FIG. 18, the upstream ends 168 of the grate ring segments are aligned with the downstream ends 175 of one of the adjacent gullets and the downstream ends 180 of the grate ring segments are aligned with the upstream ends of the other adjacent gullet. The upstream and downstream ends of the grate ring segments are blunt in the embodiment of FIG. 18; that is, they are coextensive with respective end walls of the gullets between which they extend.

Each of the gullets 172 is provided at its downstream end 175 with a reversible gullet liner 176. Each gullet liner 176 is generally L-shaped and has a first leg 177 and a similar second leg 178. The gullet liner 176 preferably is mounted to the grate by means of a bolt 184 and a nut 186, which function to attach both the gullet liner and corresponding grate ring segment to the grate, although other suitable means of attaching these components to the grate may also be used. When the gullet liner is mounted to the grate as shown, the first leg 177 of the gullet liner extends upwardly into the inside of the grate and bears against both the downstream end of its gullet and against the aligned upstream end of the respective grate ring segment.

The distal end of the first leg 177 in this embodiment of the gullet liner is shaped to form a relatively sharp cutting edge 179 with the top surface of the cutting edge being aligned with the top surface of the grate ring segment. With this configuration, wood chips and shards impaled against the cutting edge 179 by the rotating hammers are cut by the cutting edge 179, increasing the efficiency of wood break down and producing a clean uniform end product. As each piece of wood is cut in this way, the shape of the cutting edge 179 urges the cut piece downwardly through the gullet so that it is expelled from the machine immediately upon being cut.

The gullet liner 176 is formed in the region of the intersection of its two legs to define a ledge 182, which functions to engage longer or larger pieces of wood that begin to pass through the gullet to hold the pieces in place and in the path of oncoming hammers so that they can be impacted by the hammers, driven against the cutting edge 179, and cut. This prevents unacceptably long shards of wood from sliding through the gullets without being cut into a piece of an appropriate size.

As mentioned, the gullet liner 176 is reversible. To this end, each of the first and second legs 177 and 178 of the gullet liner are mirror images of each other, with the second leg 178 forming a cutting edge 181. In this way, when one cutting edge of the gullet liner becomes worn or broken, the gullet liner need only be removed by removing the nut 181, reversed so that the second leg extends through the gullet, and reattached. For this purpose, an attaching hole 187 is provided in each leg of the gullet liner for receiving the attaching bolt 184. Thus, the life of a single gullet liner is substantially doubled, further increasing the life of the grate and its components. In addition, since the upstream end 168 of the adjacent grate ring segment and the downstream end of the gullet is covered and protected by the leg 177, the life of the grate, grate rings, and the grate liner formed thereby is likewise extended significantly. Accordingly, in normal use, it is only necessary to replace the gullet liners periodically to bring the machine back to its original efficiency.

FIG. 19 illustrates an alternate embodiment of the grate ring segments and gullet liner. Here, the grate 191 has a gullet 192, tall grate ring segments 194, and short grate ring segments 193. The upstream end of each grate ring segment extends slightly beyond the respective downstream end of the gullet and is angled to form a cutting edge 196, which performs the same functions as the cutting edge 179 of gullet liner 176 (FIG. 18). A reversible L-shaped gullet liner 198 is attached to the grate by means of a bolt 202 and nut 203, which also attaches the grate ring segment 193. The gullet liner 198 has a first leg 199 that extends into and covers the downstream end of the gullet 192 to protect the gullet end from wear and deterioration. The end of the first leg 199 resides beneath and supports the end of the grate ring segment 193. Wood chips and shards impaled against the cutting edge 196 are cut and urged downwardly through the gullet 192 to be expelled from the machine as wood chips. Preferably, the downstream end of the grate ring segment 193 (not visible in FIG. 19) also is angled to define a cutting edge. In this way, the grate ring segment, like the gullet liner, is also reversible. When the grate ring segments and gullet liners become worn, they need only be removed, reversed, and reinstalled to extend their life by a factor of two.

An alternate con figuration of the end of the grate ring segment 193 is illustrated in phantom lines at 197 in FIG. 19.

This embodiment does not form a cutting edge but, instead, forms a deflection surface that functions to urge wood chips and shards upwardly back into the path of oncoming hammers or knives for further reduction into smaller pieces until the pieces fall naturally through the gullets.

FIG. 20 illustrates yet another embodiment of a grate ring segment configuration. Here, again, the grate 211 has a gullets 212, short grate ring segments 213, and tall grate ring segments 214. The upstream end of each grate ring segment is angled to form a cutting edge 216 but does not extend beyond the downstream end of the gullet as in FIG. 19. A reversible ledge plate 218 is secured to the outside of the grate 211 and extends beyond the downstream end 217 of its adjacent gullet to form a ledge 219 with respect thereto. In this embodiment, too, the downstream end of the grate ring segment 213 (not visible) preferably is formed to define a cutting edge so that the grate ring segment is reversible. When a cutting edge 216 and ledge 219 become worn, the grate ring segment 213 and ledge plate 218 are removed, reversed, and reattached to extend their lives another cycle.

In all of the forgoing embodiments, the grate ring segments, gullet liners, rotor rings, and other wear surfaces of the machine preferably are formed from hardened steel or carbon tipped steel to wear better and increase their life span. Since the grate is lined with the grate ring segments, the grate itself can be made from less expensive steel and need not be hardened or specially treated (except, perhaps, in the embodiment of FIG. 20 wherein it is desirable to harden the exposed downstream ends of the gullets).

The invention has been described herein in terms of preferred embodiments. It will be obvious to those of skill in the art, however, that various modifications, additions, and deletions might well be made to the embodiments illustrated herein without departing from the spirit and scope of the invention as set forth in the claims.

What is claimed is:

1. An apparatus for reducing wood to chips and shards of a predetermined maximum size, said apparatus comprising:

a housing;

an element mounted for rotation within said housing, said element having a surface bearing protruding members for impacting wood presented to said surface to reduce the wood into smaller pieces;

a chip sizing grate mounted to said housing spaced from said surface, said chip sizing grate having openings formed therethrough for passing wood chips and shards of a predetermined maximum size through said grate and out of said apparatus;

said chip sizing grate being oriented at an angle relative to said surface.

2. An apparatus for reducing wood to chips and shards of a predetermined maximum size as claimed in claim 1 and wherein said element is a rotating disc and wherein said surface comprises a face of said rotating disc.

3. An apparatus for reducing wood to chips and shards of a predetermined maximum size as claimed in claim 2 and wherein said grate is configured in the shape of a cone.

4. An apparatus for reducing wood to chips and shards of a predetermined maximum size as claimed in claim 3 and wherein said rotating disc has a central portion and a peripheral portion and wherein said cone-shaped grate is oriented such that the space between said grate and said disc at said central portion of said disc is less than the space between said grate and said disc at said peripheral portion of said disc.

5. An apparatus for reducing wood to chips and shards of a predetermined maximum size as claimed in claim 3 and wherein said rotating disc has a central portion and a peripheral portion and wherein said cone-shaped grate is oriented such that the space between said grate and said disc at said central portion of said disc is greater than the space between said grate and said disc at said peripheral portion of said disc.

6. An apparatus for reducing wood to chips and shards of a predetermined maximum size as claimed in claim 1 and wherein said element comprises a rotating drum having a central portion and end portions and wherein said surface comprises a surface of said rotating drum.

7. An apparatus for reducing wood to chips and shards of a predetermined maximum size as claimed in claim 6 and wherein the space between said grate and said drum at the central portion of said drum is less than the space between said grate and said drum at the end portions of said drum.

8. An apparatus for reducing wood to chips and shards of a predetermined maximum size, said apparatus comprising:

a housing;

an element for rotation in said housing and having a surface, said surface bearing protruding members for impacting wood presented to said surface to reduce the wood to smaller pieces;

a grate mounted on said housing spaced from said surface; and grate rings mounted on said grate and projecting toward said surface, at least some of said grate rings being aligned with the path of travel of predetermined ones of said protruding members on said surface to fill a portion of the space between said predetermined ones of said protruding members and said grate as said protruding members rotate with said surface.

9. An apparatus for reducing wood to chips and shards of a predetermined maximum size as claimed in claim 8 and wherein said surface is provided with a first set of protruding members that project a first distance from said surface and a second set of protruding members that project a second distance from said surface, said first distance being less than said second distance, said grate rings being aligned with the path of travel of said first set of protruding members.

10. An apparatus for reducing wood to chips and shards of a predetermined maximum size as claimed in claim 9 and wherein said grate is formed with openings aligned with the path of travel of at least some of said protruding members and wherein said grate rings are defined by ring segments mounted to said grate, each ring segment extending between successive openings along the path of travel of a protruding member in said grate.

11. An apparatus for reducing wood to chips and shards of a predetermined maximum size as claimed in claim 10 and wherein each of said ring segments has first and second ends each positioned at a respective one of said successive openings.

12. An apparatus for reducing wood to chips and shards of a predetermined maximum size as claimed in claim 11 and wherein one of said ends faces the direction of travel of said protruding member.

13. An apparatus for reducing wood to chips and shards of a predetermined maximum size as claimed in claim 12 and wherein said one of said ends is shaped to urge wood chips out of the adjacent opening in said grate.

14. An apparatus for reducing wood to chips and shards of a predetermined maximum size as claimed in claim 12 and wherein said one of said ends is shaped to urge wood chips away from the adjacent opening in said grate.

15. An apparatus for reducing wood to chips and shards of a predetermined maximum size as claimed in claim 8 and wherein said protruding members comprise hammers.

16. An apparatus for reducing wood to chips and shards of a predetermined maximum size as claimed in claim 8 and wherein said protruding members comprise knives.

17. An apparatus for reducing wood to chips and shards of a predetermined maximum size, said apparatus comprising:

a housing;

an element mounted for rotation in said housing and having a surface, said surface bearing protruding hammers for impacting wood presented to said surface to pulverize the wood and break it into smaller pieces;

at least some of said protruding hammers being aligned in an array along the direction of travel of said surface in said housing; and at least one ring segment mounted to said surface extending between a successive pair of aligned hammers in said array, said ring segment having a cross sectional extent less than the extent of the hammers between which said ring segment extends.

18. An apparatus for reducing wood to chips and shards of a predetermined maximum size as claimed in claim 17 and wherein a ring segment extends between each successive pair of aligned hammers in said array to define a ring extending completely along the path of travel of hammers in the aligned array.

19. An apparatus for reducing wood to chips and shards of a predetermined maximum size as claimed in claim 18 and wherein said hammers are arranged in a plurality of aligned arrays and wherein the hammers in some of said arrays project from said surface a distance greater than the hammers in other ones of said arrays, said ring segments extending between successive ones of the hammers in said some of said arrays.

20. An apparatus for reducing wood to chips and shards of a predetermined maximum size as claimed in claim 19 and further comprising a grate mounted on said housing and spaced from said surface, said grate being formed with openings sized to allow wood chips and shards of a predetermined maximum size to pass through said grate.

21. An apparatus for reducing wood to chips and shards of a predetermined maximum size as claimed in claim 20 and wherein said openings in said grate are aligned along the paths of travel of said hammers.

22. An apparatus for reducing wood to chips and shards of a predetermined maximum size as claimed in claim 21 and further comprising grate ring segments mounted on said grate between said grate and said surface, said grate ring segments extending between successive openings in said grate and at least partially filling the space between said grate and the respective aligned hammers as said hammers rotate with said surface.

23. An apparatus for reducing wood to chips and shards of a predetermined maximum size as claimed in claim 22 and wherein said element is a rotating disc and wherein said surface is defined on a face of said rotating disc.

24. An apparatus for reducing wood to chips and shards of a predetermined maximum size as claimed in claim 22 and wherein said element is a rotating drum and wherein said surface is defined on said rotating drum.

25. In an apparatus for reducing wood to chips and shards of a predetermined maximum size wherein a rotating element having a surface bearing protruding members is disposed in spaced relationship to a chip sizing grate having an interior surface facing said surface and openings formed in said grate for ejecting chips from the space between the surface and the grate, the improvement comprising a grate liner mounted to said interior surface of said grate for protecting said grate against abrasion and wear during use, said grate liner being selectively removable and replaceable.

26. The improvement of claim 25 and wherein said grate liner is formed by a plurality of grate ring segments each mounted to said grate.

27. The improvement of claim 26 and wherein said openings formed in said grate are aligned along the paths of travel of protruding members on said surface and wherein said grate ring segments are mounted to said grate and extending between successive pairs of openings in said grate.

28. The improvement of claim 27 and wherein at least some of said grate ring segments aligned along a path of travel of a protruding member projects further toward said surface than other ones of said grate ring segments aligned along a path of another protruding member.

29. The improvement of claim 27 and further comprising a gullet liner disposed in at least some of said openings for protecting said openings against abrasion and wear during use of said apparatus.

30. The improvement of claim 29 and wherein said gullet liners are configured to define cutting edges projecting toward said rotating surface for cutting wood into chips as the wood is processed between said surface and said grate.

31. The improvement of claim 29 and wherein said gullet liners are reversible for extended use.

32. The improvement of claim 31 and wherein said ring segments are reversible for extended use.

* * * * *